US005685528A

United States Patent [19]

Weis

[11] Patent Number: 5,685,528

[45] Date of Patent: Nov. 11, 1997

[54] PAPER WEB FEED FOR A FOLDING APPARATUS

[75] Inventor: Anton Weis, Lorsch, Germany

[73] Assignee: Koenig & Bauer-Albert Aktiengesellschaft, Wurzburg, Germany

[21] Appl. No.: 553,959

[22] Filed: Nov. 6, 1995

[30] Foreign Application Priority Data

Nov. 5, 1994 [DE] Germany ..... 44 39 615.5

[51] Int. Cl.[6] ..... B41F 13/58

[52] U.S. Cl. ..... 270/6; 270/10; 270/20.1; 270/42; 270/43

[58] Field of Search ..... 270/4, 5.01, 6, 270/10, 18, 20.1, 41, 42, 43

[56] References Cited

U.S. PATENT DOCUMENTS

| | | | |
|---|---|---|---|
| 2,195,822 | 4/1940 | Meyer . | |
| 3,948,504 | 4/1976 | Woessner et al. | 270/41 X |
| 4,279,410 | 7/1981 | Bolza-Schunemann | 270/6 |
| 4,925,170 | 5/1990 | Weis | 270/20.1 X |
| 5,123,316 | 6/1992 | Niedermaier . | |
| 5,303,909 | 4/1994 | Maylaender | 270/10 X |
| 5,377,964 | 1/1995 | Hauer | 270/4 X |

FOREIGN PATENT DOCUMENTS

| | | |
|---|---|---|
| 2435583 | 2/1976 | Germany . |
| 8915642 | 3/1991 | Germany . |
| 38 11 909 | 10/1992 | Germany . |

*Primary Examiner*—Hoang Nguyen
*Attorney, Agent, or Firm*—Jones, Tullar & Cooper, P.C.

[57] ABSTRACT

A pair of partial paper web receiving superstructure units are placed above a transverse folding unit in a folding apparatus. Either a drawing unit or a longitudinal folder and its associated folder hopper inlet can be placed between the superstructure units and the transverse folder. Use of the two superstructure units allows the folding apparatus to have a low structural height.

6 Claims, 5 Drawing Sheets

FIG. 4
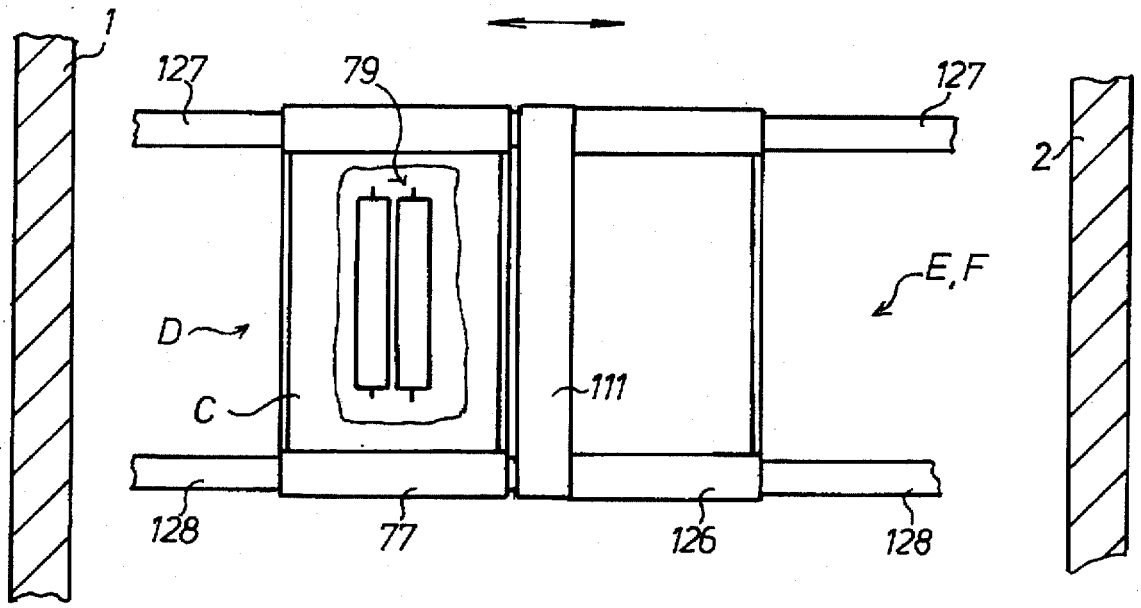
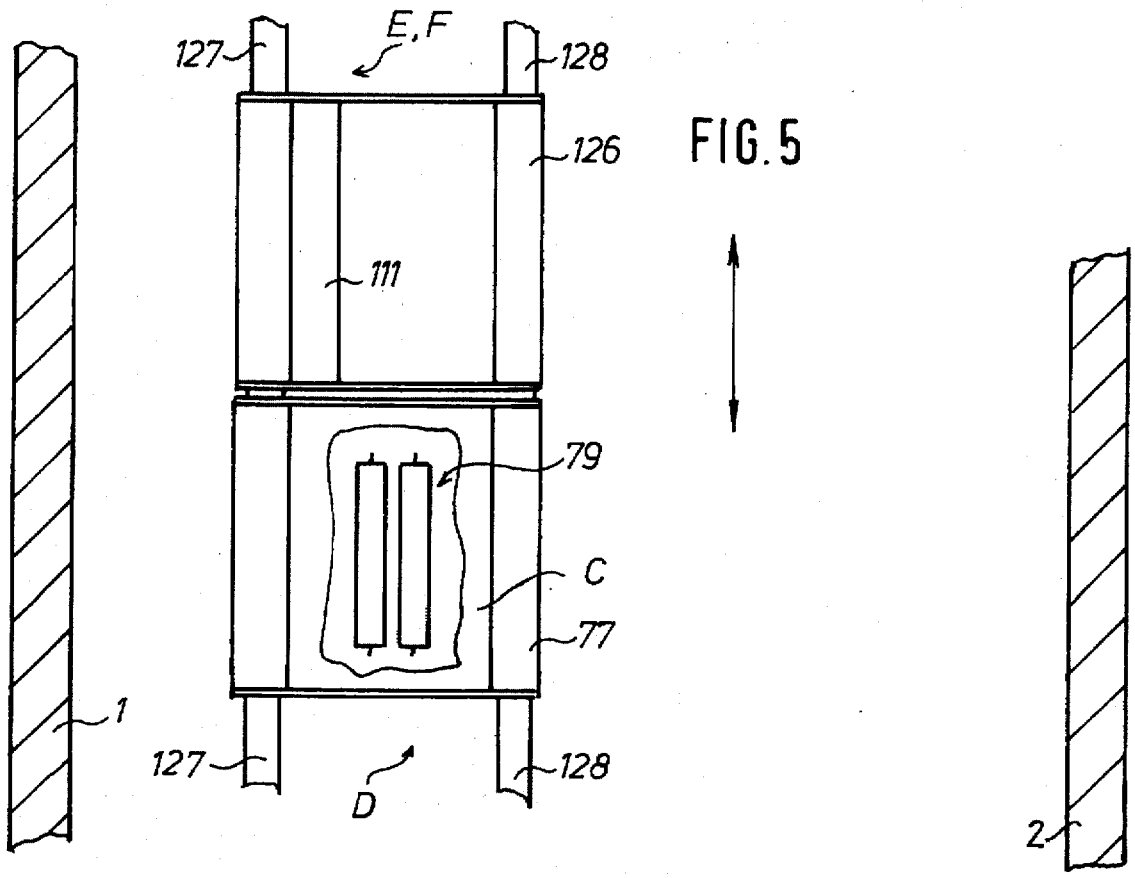
FIG. 5

PAPER WEB FEED FOR A FOLDING APPARATUS

FIELD OF THE INVENTION

The present invention is directed generally to a paper web feed for a folding apparatus. More particularly, the present invention is directed to a paper web feed for a folding apparatus of a web-fed rotary printing press. Most specifically, the present invention is directed to a paper web feed for a folding apparatus having both longitudinal and transverse folding units in a web-fed rotary printing press. A pair of similar superstructure units receive partial paper webs and properly register these partial webs. The properly registered partial webs are then combined into two partial web trains. These web trains are then directed either directly to a transverse cutting and folding unit or alternately are first directed to a longitudinal folder and then to the transverse cutter and folder. The longitudinal folding unit and its associated folder hopper inlet group, or alternatively a drawing roller pair can be moved into or out of position intermediate the superstructure units and the transverse folding unit.

DESCRIPTION OF THE PRIOR ART

In the production of printed products using a web-fed rotary printing press, it is generally known to print a plurality of pages across the width of the web using a plate cylinder having a plurality of axially spaced plates. This printed web is then cut longitudinally into a plurality of paper web segments or partial width webs. These several partial width webs can then be placed atop each other and either longitudinally folded and then transversely cut and folded or directly transversely cut and folded.

The German Patent Publication DE 38 11 909 A1 discloses, in connection with paper web feeds for a folding apparatus, the use of a superstructure consisting of drawing, registration, and guide rollers as well as turning bars with a longitudinal folding unit for so-called "hopper production" as well as for use with so-called magazine production. Especially in rotogravure printing, a wide paper web is printed and is then longitudinally cut into a plurality of partial paper webs. These partial paper webs eventually enter the transverse folding unit of the folding apparatus as a paper train of superimposed partial paper webs. As shown in this prior art German patent, to accomplish this, there are required a substantial number of drawing, registration, and guide rollers, as well as turning bars that are disposed on top of each other and which create a large superstructure. This large superstructure results in a large structural height of the rotary printing press.

It will be seen that a need exists for an arrangement for feeding the partial paper webs which overcomes the limitations of the prior art. The paper web feed for a folding apparatus in accordance with the present invention provides such a device and is a significant improvement over the prior art.

SUMMARY OF THE INVENTION

It is an object of the present invention to provide a paper web feed for a folding apparatus.

Another object of the present invention is to provide a paper web feed for a folding apparatus of a web-fed rotary printing press.

A further object of the present invention is to provide a paper web feed for a folding apparatus having a longitudinal folder and a transverse folder.

Still another object of the present invention is to provide a paper web feed for use in the feeding of wide paper web.

Yet a further object of the present invention is to provide a paper web feed for a folding apparatus which can feed a large number of partial paper webs.

Even still another object of the present invention is to provide a paper web feed having a low structural height and which can be used for hopper production as well as for magazine production.

As will be discussed in detail in the description of the preferred embodiment which is presented subsequently, the paper web feed for a folding apparatus in accordance with the present invention utilizes a pair of superstructure assemblies that are positioned generally adjacent each other between the side frames of the printing press. These two superstructure units both include turning bars, registration rollers and drawing rollers. Each superstructure unit receives various ones of the partial paper webs that have been formed by longitudinally cutting a wide paper web. Partial paper web trains are removed from the superstructure units. These partial paper web trains can then be handled directly by a transverse folding unit, after having been passed through an interposed drawing unit. Alternatively, a longitudinal folding unit and its associated hopper inlet group can be substituted for the drawing unit intermediate the superstructure units and the transverse folder. The drawing unit and the longitudinal folder with its associated hopper inlet group are supported on carriages which can be shifted into or out of the path of travel of the partial paper web trains from the two superstructure units. The superstructure units change the direction of travel of the plurality of partial paper webs from horizontal to vertical. The individual partial paper web paths in each superstructure unit are stacked atop each other. The two superstructure units have exit drawing rollers which are laterally offset on each of the several stacked levels. A free continuous partial paper web guide chute is formed between the two superstructure units.

The paper web feed for a folding unit in accordance with the present invention has several advantages over the prior art. Since each superstructure unit has one half of the total number of required partial paper web feed paths and further since the two partial paper webs are guided on each of the levels of the cooperating superstructures while each employing only one turning bar, only short paths are needed to guide the partial paper webs. The superstructure has a low structural height by being essentially divided into two superstructure units. This low structural height results in a reduction in the total structural height of the web-fed rotary printing press. Such a reduction in the total structural height of the printing press translates into reduced plant sizes and resultant lower costs.

The paper web feed in accordance with the present invention facilitates a rapid change of the folding apparatus between magazine production and hopper production. The placement of the drawing unit as well as the placement of the longitudinal folder and its associated hopper inlet group on laterally shiftable carriages above the inlet to the transverse folding unit facilitates this rapid change. The capability of the paper web feed in accordance with the present invention also achieves a reduced outlay in technical support and in equipment. The paper web feed can be used for both magazine and hopper production.

The paper web feed for a folding apparatus in accordance with the present invention overcomes the limitations of the prior art. It is a substantial advance in the art.

BRIEF DESCRIPTION OF THE DRAWINGS

While the novel features of the paper web feed for a folding apparatus in accordance with the present invention will be set forth with specificity in the appended claims, a full and complete understanding of the invention may be had by referring to the detailed description of the preferred embodiment which is presented subsequently, and as illustrated in the accompanying drawings, in which:

FIG. 4 is a top plan view of the paper web train inlet in the transverse folding unit with a selectively displaceable arrangement of the drawing roller group or the longitudinal folding group;

FIG. 5 is a top plan view of an alternative paper web train inlet;

DETAILED DESCRIPTION OF THE PREFERRED EMBODIMENT

Figure 1:
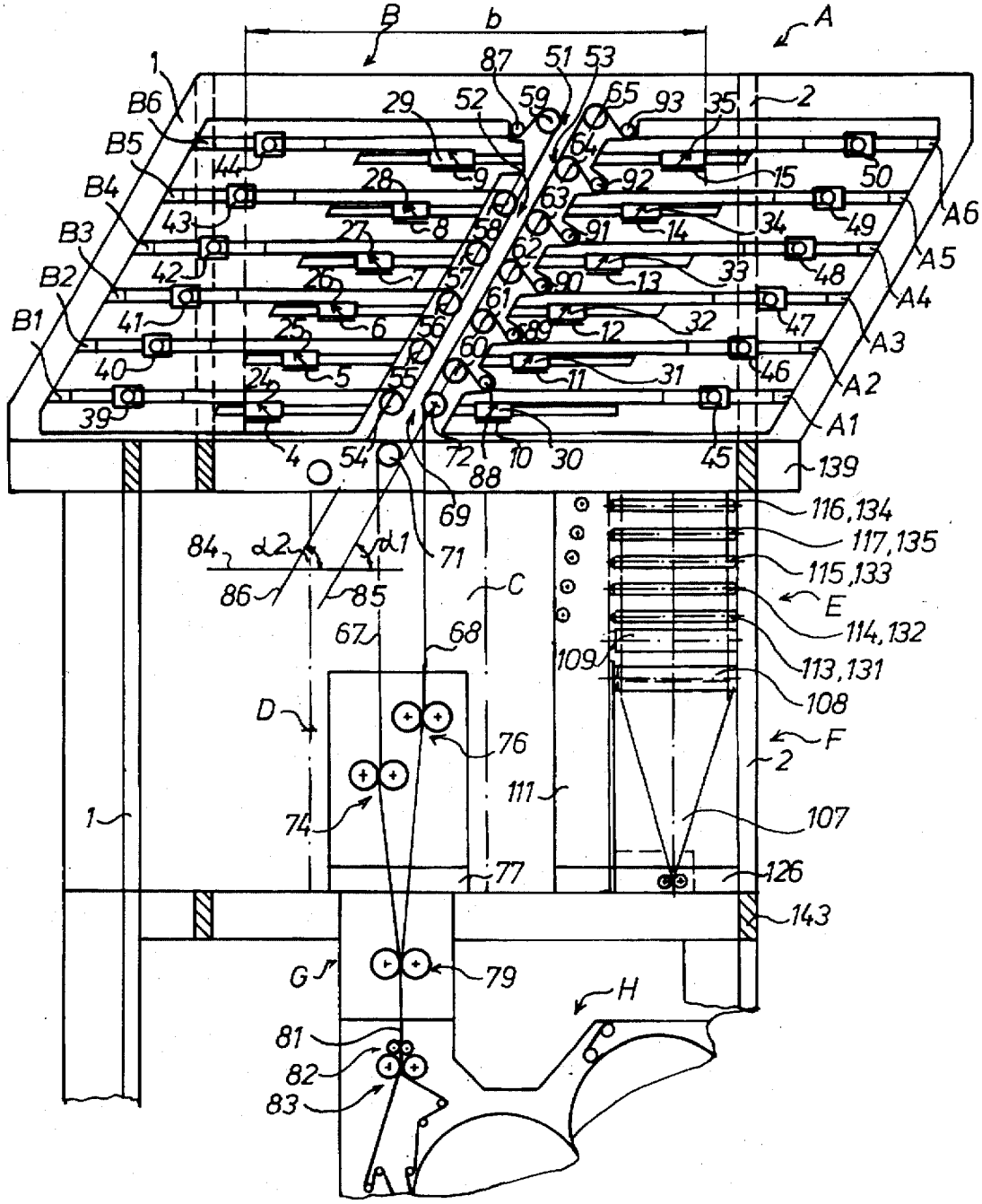
FIG. 1 is a front elevation view of a paper web feed for a folding apparatus in accordance with the present invention during magazine production.
Figure 2:
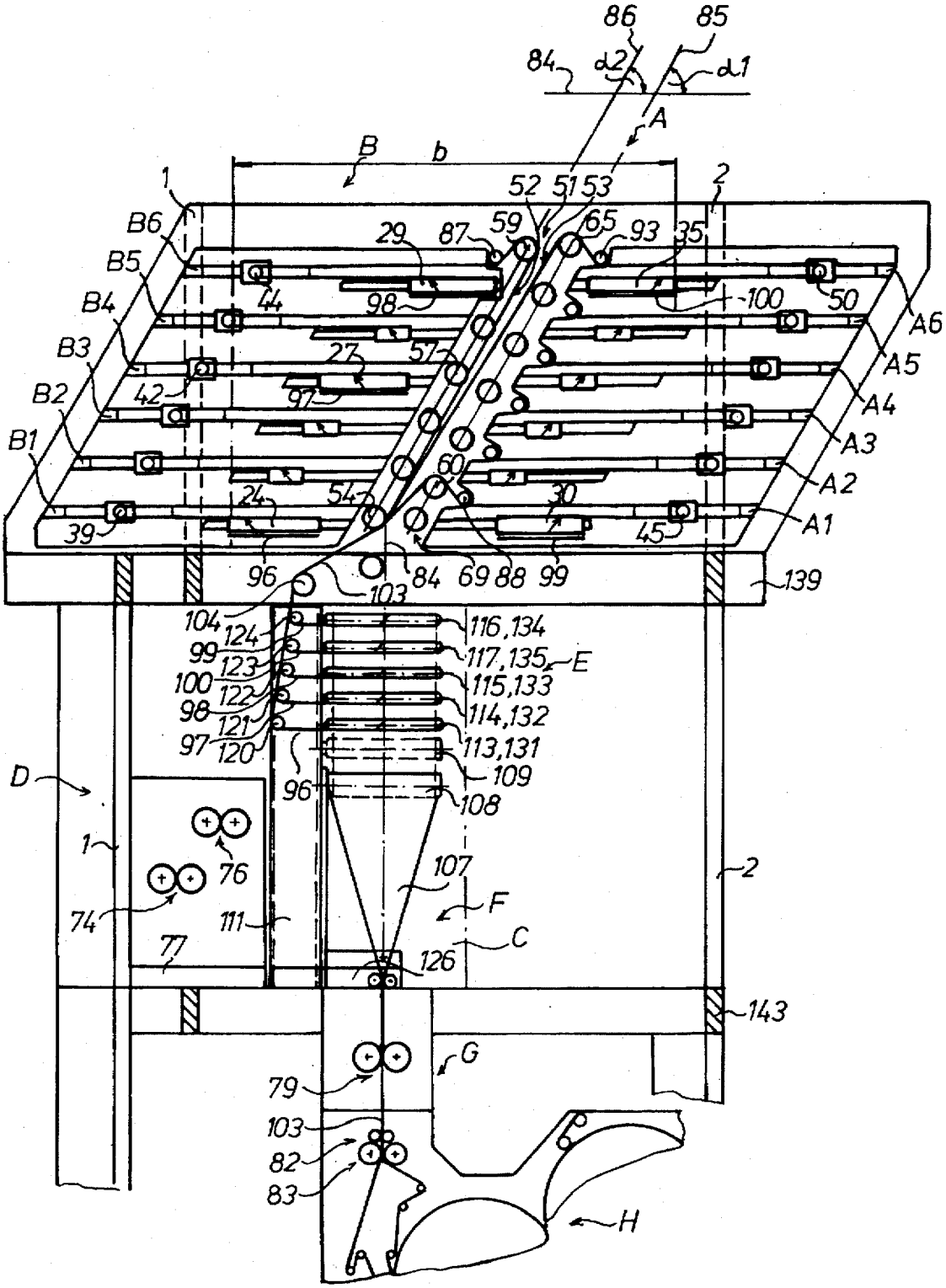
FIG. 2 is a front elevation view similar to FIG. 1 and showing the paper web feed for a folding apparatus during hopper production.

Referring initially primarily to FIGS. 1 and 2, there may be seen a preferred embodiment of a paper web feed assembly for a folding apparatus in accordance with the present invention. The paper web feed can be selectively configured to operate in so-called magazine production, as depicted in FIG. 1, or alternatively can be configured to operate in so-called hopper production, as depicted in FIG. 2. In magazine production, a plurality of partial paper webs are fed through a drawing unit D to a transverse folding unit H without being longitudinally formed and folded. In hopper production, a longitudinal folding unit F, together with an associated hopper inlet group E are substituted for the drawing unit D.

A printed paper web, which is preferably a wide printed paper web and having a paper web width "b" that is as wide as the printing cylinder in the web fed rotary printing press, exits from the press printing units which are not specifically shown in the drawings. These printing units are disposed between lateral side frames 1 and 2 of the web-fed rotary printing press which may be, for example, a web-fed rotogravure printing press. The printed wide paper web is then fed into a generally well known longitudinal cutting unit, not specifically shown, and is cut longitudinally into a plurality of partial paper webs. In the arrangement depicted in FIG. 1 of the drawings, in which the paper web feed is to a folder which is operating in magazine production, the wide printed paper web may be divided longitudinally into twelve partial paper webs 4 to 15, for example. The twelve partial paper webs 4 to 15 are guided in horizontal paths to a first superstructure A that is connected with the side frames 1 and 2, as well as to a second superstructure B, in which partial paper web guide groups A1 to A6 and B1 to B6 respectively are disposed on top of each other for guiding and deflecting the partial paper webs 4 to 9 and 10 to 15 respectively. In this configuration, two partial paper webs 4 and 10; 5 and 11; 6 and 12; 7 and 13; 8 and 14; and 9 and 15 are disposed on horizontally extending levels B1, A1; B2, A2; B3, A3; B4, A4; B5, A5; B6, A6, and which are spaced apart from each other by five spaces of the width of a partial paper web.

Figure 3:
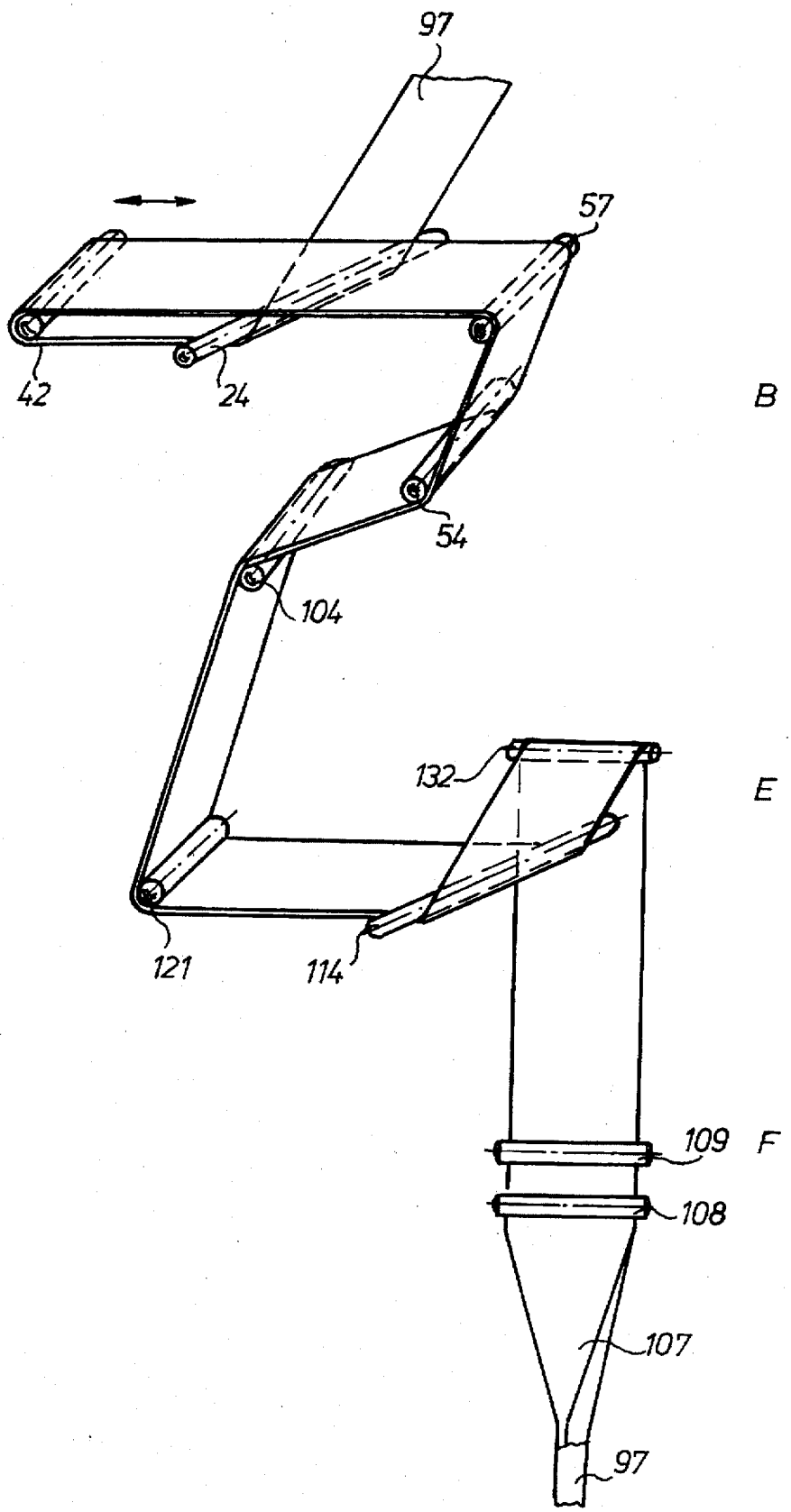
FIG. 3 is a schematic view of the course of travel of a partial paper web during hopper production, as depicted in FIG. 2.

Each one of the partial paper web guide groups A1 to A6 and B1 to B6 has one of a plurality of turning bars 24 to 35, one of a plurality of registration rollers 39 to 50 and one of a plurality of drawing rollers 54 to 65. The partial paper webs 4 to 9 of the superstructure B, or 10 to 15 of the superstructure A, each of which has been deflected by 90° over the turning bars 24 to 35, are guided in the horizontal directions and in the direction toward the respective lateral frames 1 or 2. These partial webs are subsequently turned back by 180° during passage around the registration rollers 39 to 44 and 45 to 50, which are located in the superstructures B and A and which are horizontally displaceable, as seen in FIG. 3. These partial webs then are respectively guided in pairs 4, 10; 5, 11; 6, 12; 7, 13; 8, 14; 9, 15 toward each other in the partial paper web guide groups B1 to B6 and A1 to A6 as far as a continuous partial paper web guide chute 51 that is located approximately in the center between both superstructures B and A, and on whose two sides 52, 53 respectively, one guide roller 54 to 65, that is seated fixed in place on the lateral frames, is provided for each partial paper web guide group B1 to B6 and A1 to A6 and which is usable for the vertical deflection of the paper webs 4 to 15. The guide rollers 54 to 65 are suitably designed as separately driven drawing rollers and are also identified as drawing rollers in the following description. In the process, the partial paper webs 4 to 9, guided over the drawing rollers 54 to 59 on the first chute side 52 in superstructure B, are combined to form a first partial paper web train 67, and the partial paper webs 10 to 15, guided over the drawing rollers 60 to 65 on the second chute side 53 in superstructure A, are combined to form a second partial paper web train 68. The two partial paper web trains 67 and 68 are respectively guided at the lower end 69 of the partial paper web guide chute 51 over partial paper web train guide rollers 71 and 72 to a drawing unit D that is located on a press level below the superstructures A and B, all as is shown in FIG. 1.

The drawing unit D, which is depicted in its operation position in FIG. 1, is used for "magazine production" and consists of two pairs of drawing rollers 74 and 76, with a left pair of the drawing rollers 74 being used for the first partial paper web train 67 and a right pair of drawing rollers 76 being used for the second partial paper web train 68. The pairs of drawing rollers 74, 76 are at least horizontally spaced apart. The drawing unit D can be located in separate lateral frames, not show, which are interlockingly fastened with their undersides on a carriage 77. The drawing unit D is located above a train inlet G of a transverse folding unit H located on the lowest press level. The inlet of the transverse folding unit G consists of a pair of drawing rollers 79 for drawing in a paper web train 81 that is formed of the two partial paper web trains 67 and 68, and of a downstream pair of drawing rollers 82 and a known transverse train cutting device 83 of the transverse folding unit H. All of the various appropriate shafts and axes for the registration rollers 39 to 50 and for the drawing rollers 54 to 65, as well as those for the partial paper guide rollers 71, 72, of the rollers of the drawing unit D and of the device 82, 83 extend axis-parallel in respect to each other and at right angles to the shafts or axes of the printing units of the web-fed rotary printing press. These various shafts and axes are not shown specifically in the drawings.

The partial paper web guide chute 51 for forming the partial paper web trains 67 and 68, which separates the two superstructures A and B, receives, on its chute sides 52 and 53, the drawing rollers 54 to 59 and 60 to 65, respectively disposed above each other, of the superstructures B and A, with these drawing rollers being disposed generally above each other. The drawing rollers 54 to 59 of the superstructure B are located on an inclined or sloped line 86 and the drawing rollers 60 to 65 of the superstructure A are located on a sloped line or plane 85. Both of these lines or planes 84 and 85 intersect a horizontal line 84 at an acute angle $\alpha 1$ and $\alpha 2$ and both can extend parallel with respect to each other.

Viewed in the direction of running of the partial paper webs 9 to 15, paper guide rollers 87 to 93 are disposed in front of the drawing rollers 59 to 65, respectively in order to create an improved looping of the paper around the associated drawing rollers 59 to 65.

Referring now primarily to FIG. 2, the apparatus is configured for use in which a so-called "hopper production" operation is to be performed, i.e. in an operation in which longitudinally folded partial paper web trains 67 and 68 are subsequently to be transversely cut and transversely folded. In this "hopper production" operation, a printed paper web of a width b, for example, the width of the printing cylinder, is longitudinally cut into five partial paper webs 96 to 100, each of the same width. The partial paper webs 96 to 100 are guided to the superstructures A and B in which the same parts have the same reference numerals, wherein the partial paper webs 96, 97 and 98 are turned over the turning bars 24, 27, 29 in the partial paper web guide groups B1, B4, B6 on the left of the partial paper web guide chute 51 and are horizontally guided; and the partial paper webs 99, 100 are turned over the turning bars 30 and 35 in the partial paper web guide groups A1, A6 to the right of the partial paper web guide chute 51 and, as already previously described, are guided in an approximately vertical direction to the lower end 69 of the partial paper web guide chute 51. In this mode of operation, a common paper web train 103 is formed, which is supplied, by a partial paper web guide roller 104, in a longitudinal folding unit F, which is located on a machine level below the superstructure A and B and above the lowest level which is provided with the transverse folding unit H.

The longitudinal folding unit F consists of a known longitudinal folding hopper 107 with two pairs of hopper inlet roller pairs 108 and 109 disposed above it, of which respectively only one roller is represented. The parts 107, 108, and 109 of the longitudinal folding unit F are located in a separate frame 111. The frame 111 also receives a hopper inlet group E which is located above the longitudinal folding unit F, and which consists of five turning bars 113 to 117 that are disposed above each other. Five paper guide rollers, 120 to 124, are disposed upstream of the turning bars 113 to 117 and extend axis-parallel with the partial paper train 104 and are fixed in place in the frame, extending respectively on the same level as the turning bars 113 to 117. Paper guide rollers, 131 to 135, are disposed downstream of, and on the same level as turning bar 113 to 117. In this way, the partial paper webs 96 to 100, which are fed from the superstructures B and A in a paper web train 103, are separately guided by the paper guide rollers 120 to 124 through 90° from the vertical into a horizontal direction, turned over the turning bars 113 to 117 and guided over the subsequent paper guide rollers 131 to 135 through 90° into a vertical direction, and displaced by 90° from the first vertical direction, to the longitudinal folding unit F, wherein a paper train is again formed and is longitudinally folded. The schematic representation of a guide of an individual paper web 97 is shown in FIG. 3.

The longitudinally folded paper train 103 from the longitudinal folding unit F is supplied to the transverse folding unit H on the lowest press level for further processing, after the longitudinally folded paper train 103 has passed through the roller pair 79 upstream of the transverse folding unit H, as may be seen in FIG. 2. The hopper inlet group E, as well as the longitudinal folding unit F located underneath it, inclusive of the associated frame 111, can be interlockingly fastened at the lower end in a carriage 126.

Referring now to FIGS. 2 and 5, it may be seen that the carriage 126 which receives the longitudinally folding unit E and F, and the frame 111 can be disposed on rails 127 and 128 that are fixed in place on the support, and that are horizontally displaceable to move away from the lateral side frame 2 or to approach the lateral side frame 2. The longitudinal folding unit E and F can be located directly above the pair of drawing rollers 79, i.e. over the train inlet G, on an operating location C in the working position, or next to it—but in any case on the higher press level in the position of rest as shown in FIGS. 1 and 2. The rails 127 and 128 for the carriage 126 extend horizontally and, as seen in FIG. 4, at right angles between the lateral side frame 1 and 2. In this case, it is also possible for the carriage 126 to be interlockingly connected with the carriage 77 that supports the drawing unit D, so that the drawing unit D for magazine production can be disposed, displaceable on the rails 127 and 128, above the train inlet G, or alternatively to this, the longitudinal folding unit F with the hopper inlet group E for hopper production. The carriages 77 and 126 can be moved on the rail by known linear drives, not shown, for example by electric motor-gear unit fixed on the carriages, which are interlockingly or frictionally connected with the rails 127 and 128 by means of their gears. It is of course also possible to actuate the carriages 77 and 126 separately.

In accordance with another preferred embodiment of the subject invention, it is also possible to dispose the rails 127, 128 for receiving the carriages 77, 126 horizontally in a direction parallel with the side frames, as seen in FIG. 5 so that the carriages 77 or 126, either individually or interlockingly connected with each other, can be alternatively displaceably disposed above the drawing roller pair 79, i.e. above the train inlet G of the transverse folding unit H. The drive for the carriages 77, 126 can be embodied as already described.

In accordance with a further embodiment, it is possible to dispose the hopper inlet group E displaceable separately from the longitudinal folding unit F. This can be achieved by dividing the frame 111 in its vertical extension and by displaceably and arrestingly disposing these frame sections by known technical means, such as a linear guide, on the underside 138 of a support 139 connecting the side frames 1, 2.

Figure 6:
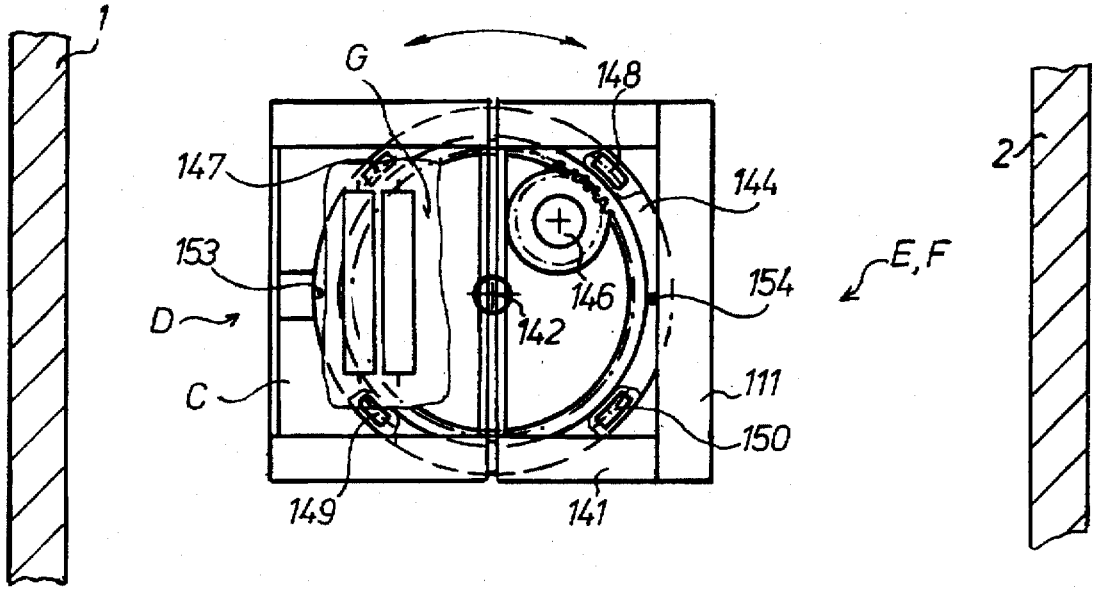
FIG. 6 is a top plan view of the paper train inlet to the transverse folding unit in a further alternative embodiment with a rotatable base frame for the drawing unit as well as for the longitudinal folding unit and with the drawing unit in the operating position.
Figure 7:
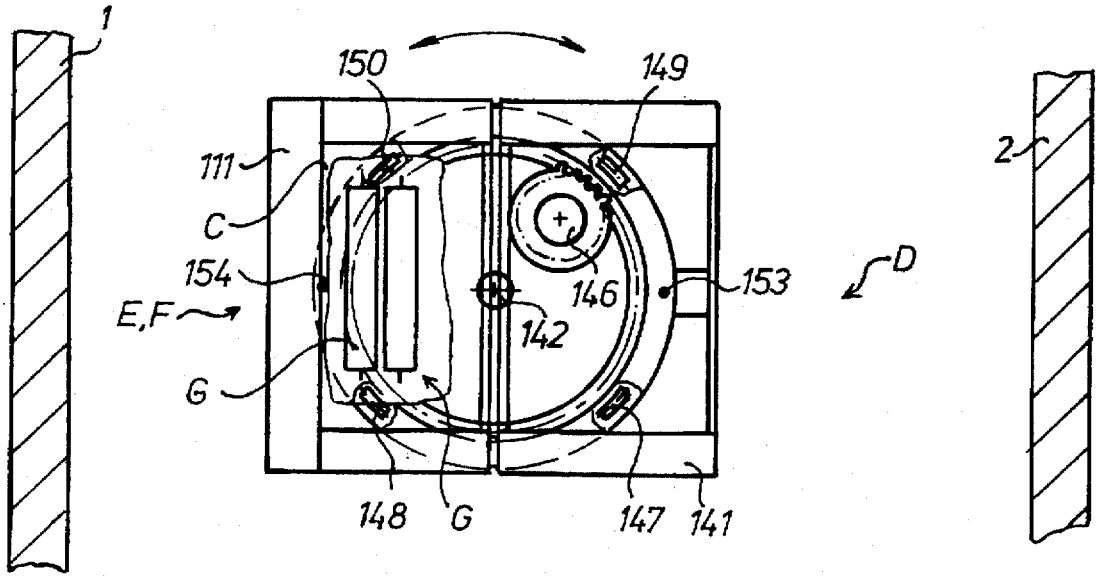
FIG. 7 is a top plan view similar to FIG. 6 but showing the longitudinal folding unit in the operating position.

Turning now to FIGS. 6 and 7, it is possible, in accordance with a further embodiment of the invention, to dispose the drawing unit D, as well as the longitudinal folding unit F and the hopper inlet group E disposed above it interlockingly connected on a common base frame 141. In this case, a shaft 142 extends in the vertical direction and is centered between the unit D and the combined units E and F. This shaft 142 is rotatably seated in the upper support 139 as well as in the lower support 143 fixed on the frame. A gear ring 144, driven by a motor-gear unit 146 that is fixed in place on the frame, can be disposed on the underside of the base frame 141. The gear ring 144, which is interlockingly connected with the base frame 141, can have such dimensions that its diameter at least corresponds to the width of the base frame 141. Rollers 147 to 150 can be disposed on its underside, which can be moved on a circular running surface, not shown, and disposed coaxially around the shaft 142 on the lower support 143. The gear ring 144 or the base frame 141 can be fixed in place in their respective operating positions by bolts 153 and 154 can be interlockingly connected with piston rods of piston-cylinder units fixed on the support. In this way, it is possible to dispose, by means of pivoting, either the drawing unit D for magazine production or the longitudinal folding unit F and/or the hopper inlet group E for hopper production in the operating position C.

The turning bars 24 to 35 can be adapted to the respective width of the partial paper webs 4 to 15 or 96 to 100. In a practical manner the turning bars are respectively overhung in their holders.

While preferred embodiments of a paper web feed for a folding apparatus in accordance with the present invention have been set forth fully and completely hereinabove, it will be apparent to one of skill in the art that a number of changes in, for example the width of the paper web, the size of the printing cylinder, the type of paper being printed and the like could be made without departing from the true spirit and scope of the present invention which is accordingly to be limited only by the following claims.

What is claimed is:

1. A paper web feed for a folding apparatus of a web fed rotary printing press comprising:

first and second superstructures for guiding and deflecting a plurality of partial paper webs longitudinally cut from a paper web from a horizontal travel direction into a vertical travel direction;

a plurality of partial paper web guide groups vertically spaced in each of said first and second superstructures, each of said guide groups including turning bars, registration devices and drawing rollers, said drawing rollers in each guide group in said first superstructure being laterally disposed from each other, said drawing rollers in each said guide group in said second superstructure being laterally disposed from each other, said drawing rollers in each vertically spaced guide group in said first and second superstructures being spaced apart from each other and opposing each other to form a free, continuous partial paper web guide chute;

a transverse folding unit positioned after, in a direction of travel of said partial paper webs, said first and second superstructures; and a drawing unit and a longitudinal folding unit supported together on a carriage intermediate said first and second superstructures and said transverse folding unit, said carriage being shiftable to selectively place one of said drawing unit and said longitudinal folding unit in a path of travel of said partial paper webs from said first and second superstructures to said transverse folding unit.

2. The paper web feed of claim 1 further including support rails for said carriage, said support rails being disposed generally horizontally and generally parallel to side frames of a web fed rotary printing press.

3. The paper web feed of claim 1 further including support rails for said carriage, said support rails being disposed generally horizontally and generally perpendicular to side frames of a web fed rotary printing press.

4. The paper web feed of claim 1 wherein said drawing rollers are separately driven.

5. A paper web feed for a folding apparatus of a web fed rotary printing press comprising:

first and second superstructures for guiding and deflecting a plurality of partial paper webs longitudinally cut from a paper web from a horizontal travel direction into a vertical travel direction;

a plurality of partial paper web guide groups vertically spaced in each of said first and second superstructures, each of said guide groups including turning bars, registration devices and drawing rollers, said drawing rollers in each guide group in said first superstructure being laterally disposed from each other, said drawing rollers in each said guide group in said second superstructure being laterally disposed from each other, said drawing rollers in each vertically spaced guide group in said first and second superstructures being spaced apart from each other and opposing each other to form a free, continuous partial paper web guide chute;

a transverse folding unit positioned after, in a direction of travel of said partial paper webs, said first and second superstructures; and a drawing unit and a longitudinal folding unit supported intermediate said first and second superstructures and said transverse folding unit on separate first and second carriages which are shiftable to selectively place one of said drawing unit and said longitudinal folding unit in a path of travel of said partial paper webs from said first and second superstructures to said transverse folding unit, said first and second carriages being interlockingly connectable to each other.

6. A paper web feed for a folding apparatus of a web fed rotary printing press comprising:

first and second superstructures for guiding and deflecting a plurality of partial paper webs longitudinally cut from a paper web from a horizontal travel direction into a vertical travel direction;

a plurality of partial paper web guide groups vertically spaced in each of said first and second superstructures, each of said guide groups including turning bars, registration devices and drawing rollers, said drawing rollers in each guide group in said first superstructure being laterally disposed from each other, said drawing rollers in each said guide group in said second superstructure being laterally disposed from each other, said drawing rollers in each vertically spaced guide group in said first and second superstructures being spaced apart from each other and opposing each other to form a free, continuous partial paper web guide chute;

a transverse folding unit positioned after, in a direction of travel of said partial paper webs, said first and second superstructures;

a drawing unit and a longitudinal folding unit supported intermediate said first and second superstructures and said transverse folding unit, one of said drawing unit and said longitudinal folding unit being selectively positioned in a path of travel of said partial paper webs from said first and second superstructures to said transverse folding unit; and a hopper inlet group in said longitudinal folding unit, said hopper inlet group and said longitudinal folder being separably displaceable, said hopper inlet group including a first plurality of vertically spaced guide rollers usable for the individual deflection of partial paper webs fed from said first and second superstructures through 90° from a first vertical direction, a group of hopper turning bars for receiving said webs from said first guide rollers and for guiding said webs in a horizontal direction, and a second plurality of vertically spaced guide rollers, said second guide rollers receiving said webs from said hopper turning bars and turning said paper webs into a second vertical travel direction which is displaced 90° from said first vertical travel direction.

* * * * *